US005612777A

United States Patent [19]

Malhotra

[11] Patent Number: 5,612,777

[45] Date of Patent: Mar. 18, 1997

[54] METHOD AND APPARATUS FOR APPLYING A CLEAR TONER RESIN CONTAINING LIGHTFASTNESS MATERIAL TO TONER IMAGES

[75] Inventor: Shadi L. Malhotra, Ontario, Canada

[73] Assignee: Xerox Corporation, Stamford, Conn.

[21] Appl. No.: 583,911

[22] Filed: Jan. 11, 1996

[51] Int. Cl.[6] ..... G03G 15/01

[52] U.S. Cl. ..... 399/226; 427/203; 430/42

[58] Field of Search ..... 355/326 R, 327, 355/328; 118/645; 427/197, 202, 203; 430/42, 45, 107

[56] References Cited

U.S. PATENT DOCUMENTS

| | | | |
|---|---|---|---|
| 3,901,698 | 8/1975 | Fukushima et al. | 96/1 R |
| 4,064,285 | 12/1977 | Mammino | 427/24 |
| 4,066,802 | 1/1978 | Clemens | 427/24 |
| 4,997,697 | 3/1991 | Malhotra | 428/195 |
| 5,176,974 | 1/1993 | Till et al. | 430/42 |
| 5,260,753 | 11/1993 | Haneda et al. | 355/326 R X |
| 5,337,132 | 8/1994 | Cherian | 355/278 |
| 5,339,148 | 8/1994 | Johnson et al. | 355/326 R X |
| 5,413,840 | 5/1995 | Mizuno | 428/195 |
| 5,506,671 | 4/1996 | Buts et al. | 355/326 R |

FOREIGN PATENT DOCUMENTS

| | | |
|---|---|---|
| 0081887 | 12/1982 | European Pat. Off. . |
| 0324192 | 1/1988 | European Pat. Off. . |
| 1373220 | 11/1974 | United Kingdom . |

OTHER PUBLICATIONS

Pond, Xerox Disclosure Journal, vol. 2, No. 5, p. 17 (Sep./Oct. 1977).

Bares, Xerox Disclosure Journal, vol. 16, No. 1, p. 69 (Jan./Feb. 1991).

"Patent Abstracts of Japan", vol. 14, No. 494, Oct. 26, 1990, p. 23, Publication No. 2–201453.

"Patent Abstracts of Japan", vol. 14, No. 494, Oct. 26, 1990, p. 23, Publication No. 2–201452.

"Patent Abstracts of Japan", vol. 14, No. 376, Aug. 14, 1990, p. 78, Publication No. 2–140757.

"Patent Abstracts of Japan", vol. 12, No. 278, Aug. 1, 1988, p. 129, Publication No. 63–058374.

*Primary Examiner*—Matthew S. Smith

[57] ABSTRACT

An apparatus and method for creating color images which are coated with a composition including a lightfastness inducing material and a hydrophobic polymeric binder which protects the images from rough handling and degradation from exposure to UV radation in the light.

4 Claims, 1 Drawing Sheet

METHOD AND APPARATUS FOR APPLYING A CLEAR TONER RESIN CONTAINING LIGHTFASTNESS MATERIAL TO TONER IMAGES

BACKGROUND OF THE INVENTION

The present invention is directed to creating high gloss, light fast toner images. Specifically such images are created by applying a mixture containing a clear, abrasion resistant toner resin and a light fast material to the toner image.

In the practice of conventional xerography, it is the general procedure to form electrostatic latent images on a xerographic surface by first uniformly charging a charge retentive surface such as a photoreceptor. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past one or more developer housings. In monochromatic imaging, the toner generally comprises black thermoplastic powder particles which adhere to the charge pattern by electrostatic attraction. The developed image is then fixed to the imaging surface or is transferred to a receiving substrate such as plain paper to which it is fixed by suitable fusing techniques.

Recently, there has been a great deal of effort directed to the development of color copiers/printers which utilize the xerographic and/or ink jet imaging process. Such efforts have resulted in the recent introduction of the Xerox™ 5775™ copier/printer, the Xerox 4900™ and the Fuji Xerox A-Color 635™ machine.

Notwithstanding all the recent development in the area of color printers and copiers there is room for improvement in the quality of color images on paper and synthetic substrates such as Mylar™ and Teslin™.

Following is a discussion of additional prior art, incorporated herein by reference, which may bear on the patentability of the present invention. In addition to possibly having some relevance to the question of patentability, these references, together with the detailed description to follow, should provide a better understanding and appreciation of the present invention.

U.S. Pat. No. 5,337,132 granted to Abraham Cherian on Aug. 9, 1994 discloses the creation of simulated photographic prints using xerography. This patent utilizes a print creation apparatus comprising a pair of platens, one of which is heated for adhering an imaged transparency to a backing sheet. The imaged transparency and the backing sheet are supported on a hard surface such as tempered glass during the adhering procedure. A predetermined pressure is applied by the platens simultaneously with the application of heat. U.S. patent applications Ser. Nos. 08/095,639, 08/095,622, 08/095,016, 08/095,136 and 08/095,639 cited in the '132 patent are also incorporated herein by reference.

U.S. Pat. No. 5,413,840 (Mizuno) discloses a decorative laminated sheet having a sense of being coated and having improved surface hardness, which is produced by laminating a polyester film excellent in transparency on the surface of a semi-rigid thermoplastic resin film supplied with a colored layer or a pattern-printed layer, and then coating a hard coat layer comprising a UV-curable coating on the surface of the polyester film of the resulting laminated film, and a process for producing the same. The invention of the '132 patent can provide a sheet not only excellent in scratch resistance, specular reflectivity and sharpness of the surface, but having a sense of being deeply coated as well.

U.S. patent Ser. No. (Attorney's Docket No. D/95463) discloses a method of creating simulated photographic-quality prints using non-photographic imaging such as xerography. As disclosed therein, a reverse reading image is formed on a transparent substrate which is adhered to a backing sheet containing a right reading image corresponding to the reverse or wrong reading image. The method provides a simulated print which exhibits enhanced optical density compared to prints where only a reverse reading image is used.

U.S. Pat. No. 4,997,697 (Malhotra) discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. patent application Ser. No. 07/828,821 filed on Sep. 31, 1992 discloses a method and apparatus for enhancing color fidelity in a printing process employing an intermediate member wherein a developing unit deposits a colorless and transparent material directly onto an intermediate member before transfer of any color toner images thereto. Alternatively, a developing unit first deposits the colorless and transparent material on a latent image member. The colorless and transparent material is then transferred to the intermediate member before transfer of any color toner images thereto.

Various approaches have been devised to enhance the appearance of a color copy. The following disclosures may be relevant to various aspects of the present invention:

Pond, Xerox Disclosure Journal, Vol. 2, No. 5, p. 17 (September/October 1977), describes depositing a layer of fine colorless toner particles on the electrostatic image of a photoconductor, followed by depositing a second layer of larger color toner particles.

Drappel et al., European Pat. Application. 0424093 (published Apr. 24, 1991; corresponds to U.S. Pat. No. 5,176,974 assigned to Xerox Corporation), describes forming a "peel layer" on an imaging device. Latent images are formed and developed on the "peel layer," and the "peel layer" is subsequently simultaneously removed from the imaging member and transferred and affixed to a substrate. The use of a transparent waxy toner is disclosed.

Sako et al., J02201453 (English language abstract; published Aug. 9, 1990), describes developing the electrostatic latent image formed on an image carrier with chromatic toners, then developing the entire surface of an image forming region with colorless, transparent toner.

Sako et al., J02201452 (English language abstract; published Aug. 9, 1990), describes mixing a color toner for making an electrostatic latent image visible with a colorless, transparent toner.

Tagawa et al., J02140757 (English language abstract; published May 30, 1990), describes developing what seems to be color toner images over the entire surface of a transfer member by using a colorless toner containing wax of a low melting point as a release agent.

Hirano et al., J63080269 (English language abstract; published Apr. 11, 1988), describes a developer composed of a color toner and a colorless, transparent toner.

Kawabata, J63058374 (English language abstract; published Mar. 14, 1988), describes an image forming method which develops the surface of the photosensitive body with a colorless, transparent toner.

Bares, Xerox Disclosure Journal, Vol. 16, No.1, p. 69 (January/February 1991), describes applying a transparent (unpigmented) toner as a final finishing step.

Fukushima et al., U.S. Pat. No. 3,901,698 (issued Aug. 26, 1975), describes a method of reversal development using two developers wherein the first developer consists of colorless or white, positively charged, toner particles.

Mammino, U.S. Pat. No. 4,064,285 (issued Dec. 20,1977), describes a method of decalcomania wherein the polymeric "subbing" layer is colorless.

Clemens, U.S. Pat. No. 4,066,802 (issued Jan. 3, 1978), describes a method of decalcomania wherein the interposed polymeric sheet is colorless.

BRIEF SUMMARY OF THE INVENTION

The present invention is directed to creating high gloss, lightfast color toner images which exhibit a high degree of scuff or abrasion resistance. Such images, as will be disclosed herein, can be created using a color xerographic copier or printer.

In carrying out the invention, a fifth developer housing is provided in a color image creation apparatus normally comprising only four developer housings. The additional housing contains a mixture of a clear polymeric material and a material which absorbs Ultraviolet Light (UV) for minimizing color image degradation due to ultraviolet light. The clear polymer comprises a material exhibiting hydrophobic properties resulting in imaged substrates which are scuff or scratch resistant as well as resistant to damage from liquids and resistant to color degradation from exposure to UV.

In the preferred embodiment of the invention, the fifth or additional developer housing occupies the first position in the development zone. Thus, the clear polymer is deposited on the photoreceptor first so that it will be on top of the composite image on the substrate. It will be appreciated that the additional developer housing may occupy the last position in the development zone.

DESCRIPTION OF THE DRAWINGS

The Figure is a schematic elevational view of an illustrative electrophotographic copier which may be utilized in carrying out the present invention.

DETAILED DESCRIPTION OF THE PREFERRED EMBODIMENT OF THE INVENTION

Figure 1:
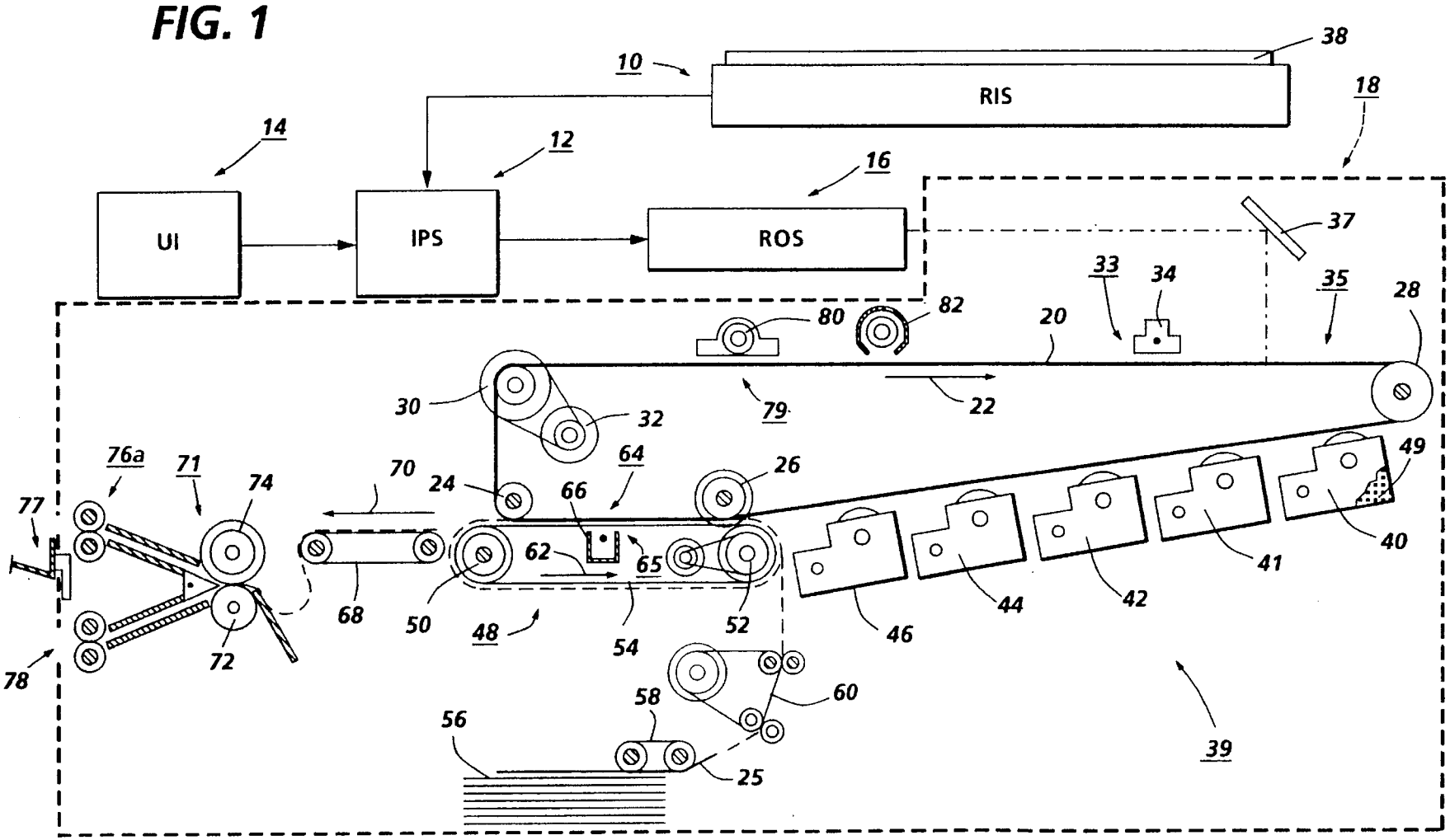

While the present invention will hereinafter be described in connection with least one preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. It will become evident from the following discussion that the present invention is equally well suited for use in a wide variety of printing systems, and is not necessarily limited in its application to the particular system shown herein.

During operation of a printing system illustrated in the Figure, a multi-color original document or photograph 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. Signals corresponding to the desired image are transmitted from IPS 12 to a ROS 16, which creates the output image. ROS 16 lays out the image in a series of horizontal scan lines with each line having a specified number of pixels per inch. ROS 16 includes a laser having a rotating polygon mirror block associated therewith. ROS 16 is utilized for exposing a uniformly charged photoconductive belt 20 of a marking engine, indicated generally by the reference numeral 18, to achieve a set of subtractive primary latent images. The latent images are developed with cyan, magenta, and yellow developer material, respectively. These developed images are transferred to a final substrate in superimposed registration with one another to form a multi-color image on the substrate. This multi-color image is then heat and pressure fused to the substrate thereby forming a multi-color toner image thereon. The printing system 9 is capable of printing conventional right reading toner images on plain paper or mirror images on various other kinds of substrates utilized in the commercially available 5775 TRADEMARK copier. With continued reference to the Figure, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-color original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16, ROS 16 includes a laser with a rotating polygon mirror block. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

The document 38 may comprise a color photographic print. It will be appreciated that various other documents may be employed without departing from the scope and true spirit of the invention.

After the electrostatic latent images have been recorded on photoconductive belt 20, the belt advances such latent images to a development station, indicated generally by the reference numeral 39. The development station includes five individual developer units indicated by reference numerals 40, 41, 42, 44, and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 41, 42, and 43, respectively, apply toner particles of a specific color which corresponds to a compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 41 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

The developer unit 40 contains a mixture 49 of clear toner or hydrophobic polymeric resin particles and a light fast material together with carrier particles as well as other suitable additives. The developer unit 40 may be the first unit, as shown in the Figure, to deposit some of its contents on the photoreceptor or it may be the last. In either case, the mixture of clear hydrophobic toner resin and light fast material provides a scuff or scratch resistant coating for the image on the substrate as well as providing protection of the color images from UV rays. Additionally, use of the clear toner also improves the gloss characteristics of the final images.

Each of the developer units is moved into and out of an operative position. In the operative position, the magnetic brush is closely adjacent the photoconductive belt, while in the non-operative position, the magnetic brush is spaced therefrom. During development of each electrostatic latent image, only one developer unit is in the operative position, the remaining developer units are in the non-operative position. This ensures that each electrostatic latent image is developed with toner particles of the appropriate color without commingling.

It will be appreciated by those skilled in the art that scavengeless or non-interactive development systems well known in the art could be used in lieu of magnetic brush developer structures. The use of non-interactive developer systems for all but the first developer housing would make it unnecessary for movement of the developer housings relative to the photoconductive imaging surface.

After development, the toner image is moved to a transfer station, indicated generally by the reference numeral 65. Transfer station 65 includes a transfer zone, generally indicated by reference numeral 64. In transfer zone 64, the toner image is transferred or deposited onto to a substrate 25. At transfer station 65, a substrate transport apparatus, indicated generally by the reference numeral 48, moves the substrate 25 into contact with photoconductive belt 20. Substrate transport 48 has a pair of spaced belts 54 entrained about a pair of substantially cylindrical rollers 50 and 52. A substrate gripper (not shown) extends between belts 54 and moves in unison therewith. The substrate 25 is advanced from a stack of substrates 56 disposed on a tray. A friction retard feeder 58 advances the uppermost substrate from stack 56 onto a pre-transfer transport 60. Transport 60 advances substrate 25 to substrate transport 48. Substrate 25 is advanced by transport 60 in synchronism with the movement of substrate gripper, not shown. In this way, the leading edge of substrate 25 arrives at a preselected position, i.e. a loading zone, to be received by the open substrate gripper. The substrate gripper then closes securing substrate 25 thereto for movement therewith in a recirculating path. The leading edge of substrate 25 is secured releasably by the substrate gripper. As belts 54 move in the direction of arrow 62, the substrate moves into contact with the photoconductive belt, in synchronism with the toner image developed thereon. At transfer zone 64, a corona generating device 66 sprays ions onto the backside of the substrate so as to charge the substrate to the proper electrostatic voltage magnitude and polarity for attracting the toner image from photoconductive belt 20 thereto. The substrate remains secured to the substrate gripper so as to move in a recirculating path for three cycles. In this way, three different color toner images are transferred to the substrate in superimposed registration with one another to form a composite multicolor image 67.

Referring again to the Figure, one skilled in the art will appreciate that the substrate may move in a recirculating path for four cycles when under color removal and black generation is used and up to eight cycles when the information on two original documents is being merged onto a single substrate. Each of the electrostatic latent images recorded on the photoconductive surface is developed with the appropriately colored toner and transferred, in superimposed registration with one another, to the substrate to form a multi-color facsimile of the colored original document. As may be appreciated, the imaging process is not limited to the creation of color images. Thus, high optical density black and white simulated photographic-quality prints may also be created using the process disclosed herein.

After the last transfer operation, the substrate gripper opens and releases the substrate 25. A conveyor 68 transports the substrate, in the direction of arrow 70, to a heat and pressure fusing station, indicated generally by the reference numeral 71, where the transferred toner image is permanently fused to the substrate. The fusing station includes a heated fuser roll 74 and a pressure roll 72. The substrate passes through the nip defined by fuser roll 74 and pressure roll 72. The toner image contacts fuser roll 74 so as to be affixed to the transparent substrate. Thereafter, the substrate is advanced by a pair of rolls 76 to an output tray 78. The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

The mixture 49 contained in the developer unit 40 comprises (1) a binder in the form of a clear resin toner which is selected from the group consisting of (A) polyesters; (B) polyvinyl acetals; (C) vinyl alcohol-vinyl acetal copolymers; (D) polycarbonates; and (E) styrene - alkyl alkyl acrylate copolymers and styrene - aryl alkyl acrylate copolymers; (F) styrene-diene copolymers;(G) styrene - maleic anhydride copolymers; (H) styrene - allyl alcohol copolymers; and mixtures thereof; (2) charge control additives such as alkyl pyridinium halides, cetyl pyridinium chloride, cetyl pyridinium tetrafluoroborates, quaternary ammonium sulfate and sulfonate compounds, such as distearyl dimethyl ammonium methyl sulfate; (3) Surface additives such as straight silica, colloidal silica, Unilin, polyethylene waxes, polypropylene waxes, aluminum oxide, stearic acid, polyvinylidene fluoride, and the like; (4) Surfactants such as nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether, and the like; and (5) a light fastness inducing agent such as 1,2-hydroxy-4-(octyloxy)benzophenone, 2-(4-benzoyl-3-hydroxyphenoxy) ethylacrylate and the like. Preferably, the binder comprises a polycarbonate in order to provide the toner image with a finish that exhibits excellent abrasion resistance.

The light or lightfastness inducing material or agent contained in the mixture 49 comprises a UV absorbing compound selected from the group consisting of 2-(4-benzoyl-3-hydroxyphenoxy)ethylacrylate (Cyasorb UV-416, #41,321-6, available from Aldrich chemical company), 1,2-hydroxy-4-(octyloxy)benzophenone (Cyasorb UV-531, 41,315-1, available from Aldrich chemical company), poly[2-(4-benzoyl-3-hydroxyphenoxy)ethylacrylate] (Cyasorb UV-2126, #41,323-2, available from Aldrich chemical company), hexadecyl 3,5-di-tert-butyl-4-hydroxybenzoate(Cyasorb UV-2908,#41,320-8, available from Aldrich chemical company), poly[N,N-bis(2,2,6,6-tetramethyl-4-piperidinyl)-1,6-hexanediamine-co -2,4-dichloro-6-morpholino-1,3,5-triazine) (Cyasorb UV-346, #41,324-0, available from Aldrich chemical company), 2-dodecyl-N-(2,2,6,6-tetramethyl-4-piperidinyl) succinimide(Cyasorb UV-3581, #41,317-8, available from Aldrich chemical company), 2-dodecyl-N-(1,2,2,6,6-pentamethyl-4-piperidinyl) succinimide(Cyasorb UV-3604, #41,318-6, available from Aldrich chemical company), N-(1-acetyl-2,2,6,6-tetramethyl-4-piperidinyl)-2-dodecylsuccinimide (Cyasorb UV-3668, #41,319-4, available from Aldrich chemical company), 1-[N-[poly(3-allyloxy-2-hydroxypropyl)-2-aminoethyl]-2-imidazolidinone (#41,026-8, available from Aldrich chemical company),poly(2-ethyl-2-oxazoline)(#37,284-6, #37,285-4,#37,397-4, available from Aldrich chemical company). The lightfastness inducing agent 51 may also include antioxidant and antiozonant compounds such as 2,2?-methyleneb is (6-tert-butyl-4-methylphenol)(Cyanox 2246, #41,315-5, available from Aldrich chemical company), 2,2?-methyleneb is (6-tert-butyl-4-ethylphenol) (Cyanox 425, #41,314-3, available from Aldrich chemical company), Tris(4-tertobutyl-3-hydroxy-2,6-dimethylbenzyl)isocyanurate (Cyanox 1790, #41,322-4, LTDP, #D12,840-6, available from Aldrich chemical company), didodecyl 3,3?-thiodipropionate (Cyanox, LTDP, #D12,840-6, available from Aldrich chemical company), ditridecyl 3,3?-thiodipropionate (Cyanox 711, #41,311-9, available from Aldrich chemical company), ditetradecyl 3,3?-thiodipropionate (Cyanox, MTDP, #41,312-7, available from Aldrich chemical company),ditoctadecyl 3,3?-thiodipropionate (Cyanox, STDP, #41,310-0, available from Aldrich chemical company), 1,3,5-trimethyl-2,4,6-tris (3,5-di-tert-butyl-4-hydroxybenzyl-)benzene(Ethanox 300,#41,328-3, available from Aldrich chemical company), 2,6-ditert-butyl-4-(dimethylaminomethyl)phenol (Ethanox 703,#41,327-5, available from Aldrich Chemical Company).

Any suitable substrate can be employed. Illustrative examples of commercially available internally and externally (surface) sized papers include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto, Sanyo, and coated base papers available from companies such as Scholler Technical Papers, Inc. and the like, Examples of substantially transparent substrate materials include polyesters, including Mylar™, available from E.I. Du Pont de Nemours & Company, Melinex™, available from Imperial Chemicals, Inc., Celanar™, available from Celanese Corporation, polyethylene naphthalates, such as Kaladex PEN Films, available from Imperial Chemicals, Inc., polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI Americas Incorporated, those prepared from biphenylene, such as Astrel™, available from 3M Company, poly (arylene sulfones), such as those prepared from crosslinked poly(arylene ether ketone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet.

Specific embodiments of the invention will now be described in detail. These examples are intended to be illustrative, and the invention is not limited to the materials, conditions, or process parameters set forth in these embodiments. All parts and percentages are by weight unless otherwise indicated

EXAMPLE I

Light fast clear resin composition based on polyester resin to be used in combination with polyester toners of the Xerox 5760 MajestiK Digital Color Copier were prepared as follows: 46 grams of binder polyester (same polyester resin which was used in the preparation of colored toners of the Xerox 5760 MajestiK Digital Color Copier),4 grams of surfactant polyethylene oxide such as POLY OX WSRN-3000, available from Union Carbide Corporation, 4 grams of the charge control agent such as benzyl dodecyl dimethyl ammonium bromide (mp 46°–48° C.) (Aldrich 28,088-7),4 grams of binder ethylene-vinylacetate copolymer such as #786 having 50 percent by weight vinylacetate content and available from Scientific Polymer Products, 1 gram of UV absorbing compound such as 2-(4-benzoyl-3-hydroxyphenoxy)ethylacrylate (Cyasorb UV-416, #41,321-6,available from Aldrich chemical company),0.5 grams of antioxidant compound such as 2,2'-methylenebis(6-tert-butyl-4-methylphenol)(Cyanox 2246, #41,315-5, available from Aldrich chemical company),and 0.5 grams of antioxidant and antiozonant compound such as 2,6-ditert-butyl-4-(dimethylaminomethyl)phenol (Ethanox 703,#41,327-5, available from Aldrich chemical company),were melt blended at 120° C. for a period of 20 minutes at 100 RPM in a Haake Buchler (HBI System 90,New Jersey,U.S.A) melt mixer and jetted as 7 micron particles of Light fast clear resin composition This Light fast clear resin composition was placed in a fifth housing of a Lab Model Xerox 5760 MajestiK Digital Color Copier having cyan,magenta,yellow and black toners in the first,second,third,and fourth housing respectively. Once the desired unfused images were generated on paper,these were further toned with the Light fast clear resin composition from the fifth housing and fused at 140° C. These images had optical density values of 1,40 (cyan),1.25 (magenta),0.87 (yellow) and 1 59 (black). These images had a gloss value of 90 gloss units, were waterfast when washed with water for 2 minutes at 50° C. and lightfast for a period of three months without any change in their optical density.

EXAMPLE II

Light fast clear resin composition based on styrene-butadiene resin to be used in combination with styrene-butadiene toners of the Xerox 5775 Color Copier were prepared as follows: 46 grams of binder styrene-butadiene resin (same styrene-butadiene resin as that containing about 85 percent by weight styrene monomer and prepared as disclosed in U.S. Pat. No. 4,558,108, the disclosure of which is totally incorporated herein by reference, which was used in the preparation of colored toners of the Xerox 5775 Color Copier),4 grams of surfactant ethylene oxide/isoprene/ethylene oxide triblock copolymer, which can be synthesized via anionic polymerization of isoprene with sodium naphthalene in tetrahydrofuran as solvent at −78° C. and then adding monomer ethylene oxide and polymerizing the reaction for three days, after which time the reaction is quenched with methanol, the ethylene oxide content in the aforementioned triblock copolymer is 50 percent by weight, 4 grams of the charge control agent such as hexadecyl tributyl phosphonium bromide (mp 57°–60° C.) (Aldrich 27,620-0),4 grams of binder ethylene-vinylacetate copolymer such as #506 having 9 percent by weight vinylacetate content and available from Scientific Polymer Products, 1 gram of UV absorbing compound such as 2-(4-benzoyl-3-hydroxyphenoxy)ethylacrylate (Cyasorb UV-416, #41,321-6,available from Aldrich chemical company),0.5 grams of antioxidant compound such as 2,2'-methylenebis(6-tert-butyl-4-methylphenol)(Cyanox 2246, #41,315-5, available from Aldrich chemical company),and 0.5 grams of antioxidant and antiozonant compound such as ditoctadecyl 3,3[redacted] -thiodipropionate (Cyanox ,STDP, #41,310-0, available from Aldrich chemical company),were melt blended at 120° C. for a period of 20 minutes at 100 RPM in a Haake Buchler (HBI System 90,New Jersey,U.S.A) melt mixer and jetted as 7 micron particles of Light fast clear resin composition. This Light fast clear resin composition was placed in a fifth housing of a Lab Model Xerox 5775 Color Copier having cyan,magenta,yellow and black toners in the first,second, third,and fourth housing respectively. Once the desired unfused images were generated on paper,these were further toned with the Light fast clear resin composition from the fifth housing and fused at 150° C. These images had optical density values of 1,35 (cyan), 1.20 (magenta),0.85 (yellow) and 1.50 (black).These images had a gloss value of 80 gloss units, were waterfast when washed with water for 2 minutes at 50° C. and lightfast for a period of three months without any change in their optical density.

EXAMPLE III

Light fast clear resin composition based on polyester resin to be used in combination with polyester toners of the Xerox 5760 MajestiK Digital Color Copier were prepared as described in Example I and was placed in a fifth housing of a Lab Model Xerox 5760 MajestiK Digital Color Copier having cyan,magenta,yellow and black toners in the first, second,third,and fourth housing, respectively. The untoned image on the imaging member in the Lab Model Xerox 5760 MajestiK DigitalColor Copier is developed first with the light fast clear resin composition, followed by toning the image with colored toner resin composition. The multi layered developed image is subsequently transferred to a recording sheet such as paper and fused at 140° C. These images had optical density values of 1,42 (cyan),1.27 (magenta),0.85 (yellow) and 1.55 (black). These images had a gloss value of 95 gloss units, were waterfast when washed with water for 2 minutes at 50° C. and lightfast for a period of three months without any change in their optical density.

Other modifications of the present invention may occur to those skilled in the art subsequent to a review of the present application, and these modifications, including equivalents thereof, are intended to be included within the scope of the present invention.

What is claimed is:

1. Apparatus for creating color toner images, said apparatus comprising:

means including a plurality of developer housings for forming color toner images on a charge retentive surface;

means including a developer housing for depositing a composition comprising a scratch resistant polymer material and a lightfastness inducing material on said charge retentive surface prior to the formation of said color toner images thereon, said lightfastness material comprising a UV absorber selected from the group consisting of 2-(4-benzoyl-3-hydroxyphenoxy) ethylacrylate; 1,2-hydroxy-4-(octyloxy) benzophenone; poly[2-(4-benzoyl-3-hydroxyphenoxy) ethylacrylate]; hexadecyl 3,5-di-tert-butyl-4-hydroxybenzoate; poly [N,N-bis(2,2,6,6-tetramethyl-4-piperidinyl)-1; 6-hexanediamine-co-2, 4-dichloro-6-morpholino-1,3,5-triazine); 2-dodecyl-N-(2,2,6,6-tetramethyl-4-piperidinyl) succinimide; 2-dodecyl-N-(1,2,2,6,6-pentamethyl-4-piperidinyl) succinimide; N-(1-acetyl-2,2,6,6-tetramethyl-4-piperidinyl)-2-dodecylsuccinimide; 1-[N-[poly(3-allyloxy-2-hydroxypropyl)-2-aminoethyl]-2-imidazolidinone; poly(2-ethyl-2-oxazoline) and an antioxidant; and means for fusing said color toner images and said scratch resistant material to a substrate.

2. Apparatus according to claim 1 wherein said lightfastness inducing material is present in said composition in an amount of from about 0.5 percent by weight to about 20 percent by weight.

3. A method for creating color toner images, said method including the steps of:

forming color toner images on a charge retentive surface using a plurality of developer housings;

using a developer housing, depositing a composition comprising a clear scratch resistant polymer material and a UV absorbing lightfastness inducing material on said charge retentive surface, said lightfastness material being selected from the group consisting of 2-(4-benzoyl-3-hydroxyphenoxy) ethylacrylate; 1,2-hydroxy-4-(octyloxy) benzophenone; poly[2-(4-benzoyl-3-hydroxyphenoxy) ethylacrylate]; hexadecyl 3,5-di-tert-butyl-4-hydroxybenzoate; poly[N,N-bis(2,2,6,6-tetramethyl-4-piperidinyl)-1; 6-hexanediamine-co-2, 4-dichloro-6-morpholino-1,3,5-triazine); 2-dodecyl-N-(2,2,6,6-tetramethyl-4-piperidinyl) succinimide; 2-dodecyl-N-(1,2,2,6,6-pentamethyl-4-piperidinyl) succinimide; N-(1-acetyl-2,2,6,6-tetramethyl-4-piperidinyl)-2-dodecylsuccinimide; 1-[N-[poly(3-allyloxy-2-hydroxypropyl)-2-aminoethyl]-2-imidazolidinone; poly(2-ethyl-2-oxazoline); and fusing said toner images and said composition to a substrate.

4. The method according to claim 3 wherein said lightfastness inducing material is present in said composition in an amount of from about 0.5 percent by weight to about 20 percent by weight.

* * * * *